US007703306B2

(12) United States Patent
Shaffer

(10) Patent No.: US 7,703,306 B2
(45) Date of Patent: Apr. 27, 2010

(54) CLOTHES WASHER RECIRCULATION SYSTEMS AND METHODS

(75) Inventor: Timothy Scott Shaffer, La Grange, KY (US)

(73) Assignee: General Electric Company, Schenectady, NY (US)

( * ) Notice: Subject to any disclaimer, the term of this patent is extended or adjusted under 35 U.S.C. 154(b) by 963 days.

(21) Appl. No.: 10/881,070

(22) Filed: Jun. 30, 2004

(65) Prior Publication Data

US 2006/0000030 A1 Jan. 5, 2006

(51) Int. Cl.
*D06F 33/02* (2006.01)

(52) U.S. Cl. ..... 68/12.02; 68/12.05; 68/12.19; 68/184; 8/159

(58) Field of Classification Search ..... 8/159; 68/12.02, 12.05, 12.19, 184
See application file for complete search history.

(56) References Cited

U.S. PATENT DOCUMENTS 4,162,621 A 7/1979 Stone
4,168,615 A 9/1979 Condit
4,637,231 A 1/1987 McMillan et al.
4,986,093 A 1/1991 Pastryk et al.
4,987,627 A 1/1991 Cur et al.
5,460,018 A 10/1995 Werner et al.
5,758,377 A * 6/1998 Cimetta et al. ..... 8/158
6,029,298 A * 2/2000 Dausch et al. ..... 8/159
6,134,925 A * 10/2000 Fujii et al. ..... 68/12.04
2003/0097719 A1 * 5/2003 Choi et al. ..... 8/158

* cited by examiner

*Primary Examiner*—Frankie L Stinson
*Assistant Examiner*—Samuel A Waldbaum
(74) *Attorney, Agent, or Firm*—George L. Rideout, Esq.; Armstrong Teasdale LLP

(57) ABSTRACT

A washing machine is provided that includes a tub and a perforated basket rotationally mounted within the tub for relative rotation therewith. A recirculation system is coupled between the tub and the basket and is configured to remove wash liquid from the tub and return wash liquid to the basket. A controller is operatively coupled to the washing machine. The controller is configured to begin recirculation of concentrated wash liquid after an initial fill during a basket slow spin and continue the recirculation of concentrated wash liquid for a predetermined time period prior to a complete fill.

11 Claims, 4 Drawing Sheets

CLOTHES WASHER RECIRCULATION SYSTEMS AND METHODS

BACKGROUND OF THE INVENTION

This invention relates generally to washing machines, and more particularly, to methods and apparatus for reducing water usage and energy consumption in a washing machine.

Washing machines typically include a cabinet that houses an outer tub for containing wash and rinse water, a perforated clothes basket within the tub, and an agitator within the basket. A drive and motor assembly is mounted underneath the stationary outer tub to rotate the basket and the agitator relative to one another, and a pump assembly pumps water from the tub to a drain to execute a wash cycle. See, for example, U.S. Pat. No. 6,029,298.

Known washing machines fill large loads with almost 22 gallons of water to ensure laundry is safely wetted with detergent solution during wash cycle or rinse water during rinse cycle. Recent proposals by the Department of Energy and certain state regulatory bodies could impose standards that will require reduction in water use and overall energy use. The desired levels would not permit large loads to be properly wetted nor properly agitated during the wash cycle. Both washability and Danish wear scores have large variations across the loads under these conditions. Wash performance must be balanced against time constraints, hot water use, electrical energy use, and laundry wear.

BRIEF DESCRIPTION OF THE INVENTION

In one aspect, a washing machine is provided. The washing machine includes a tub and a perforated basket rotationally mounted within the tub for relative rotation therewith. A recirculation system is coupled between the tub and the basket and is configured to remove wash liquid from the tub and return wash liquid to the basket. A controller is operatively coupled to the washing machine. The controller is configured to begin recirculation of concentrated wash liquid after an initial fill during a basket slow spin and continue the recirculation of concentrated wash liquid for a predetermined time period prior to a complete fill.

In another aspect, a washing machine is provided that includes a tub, a perforated basket rotationally mounted within the tub for relative rotation therewith, and a recirculation system coupled between the tub and the basket. The recirculation system is configured to remove wash liquid from the tub and return wash liquid to the basket. A controller is operatively coupled to the washing machine. The controller is configured to control the recirculation system to recirculate wash liquid after a final fill at a recirculation rate such that wash liquid is removed from an annular space between the tub and the basket and returned to the basket maintaining wash liquid in the basket at a first level while maintaining wash liquid in the annular space at a second level lower than the first level.

In another aspect, a method for reducing water consumption during a wash cycle in a washing machine including a perforated basket and a recirculation system is provided. The method includes wetting the laundry load during a slow basket spin with an initial fill of wash liquid prior to the wash cycle, recirculating the initial fill of wash liquid in a pretreat cycle with a slow basket spin for a predetermined time period, recirculating the wash liquid during the wash cycle final fill with a slow basket spin, and recirculating the wash liquid after final fill and during agitation at a recirculation rate wherein wash liquid in the basket is maintained at a first level while wash liquid in an annular space between the tub and basket is maintained at a second level less than the first level.

DETAILED DESCRIPTION OF THE INVENTION

Figure 1:
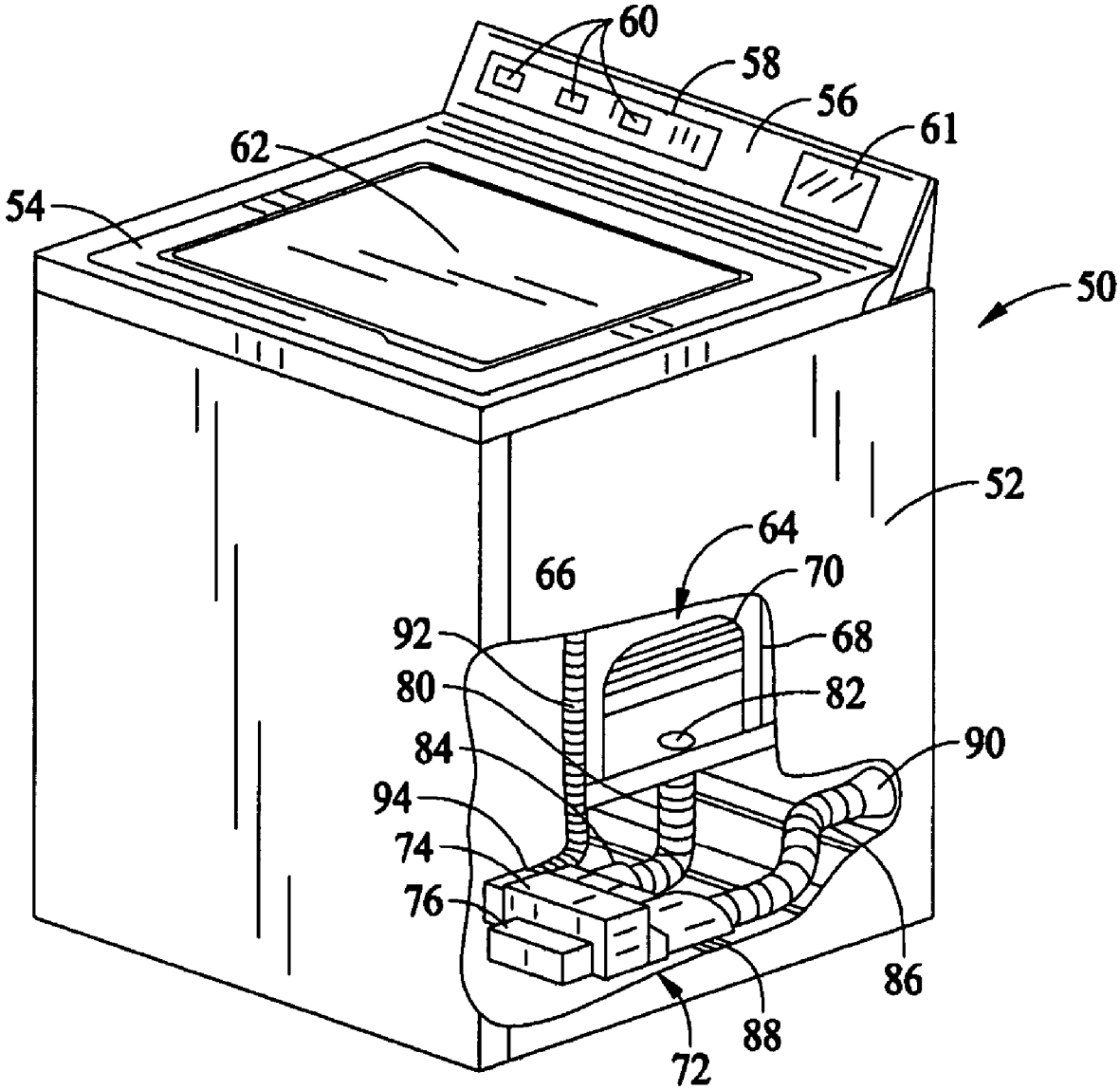
FIG. 1 is a perspective cutaway view of an exemplary washing machine.

FIG. 1 is a perspective view partially broken away of an exemplary washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 50 is a vertical axis washing machine.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84. A first pump outlet hose 86 extends from a first pump outlet 88 to an appliance washing machine water outlet 90 and ultimately to a building plumbing system discharge line (not shown) in flow communication with outlet 90. A second pump outlet hose 92 extends from a second pump outlet 94 to a basket inlet tube 110 (shown in FIG. 2).

Figure 2:
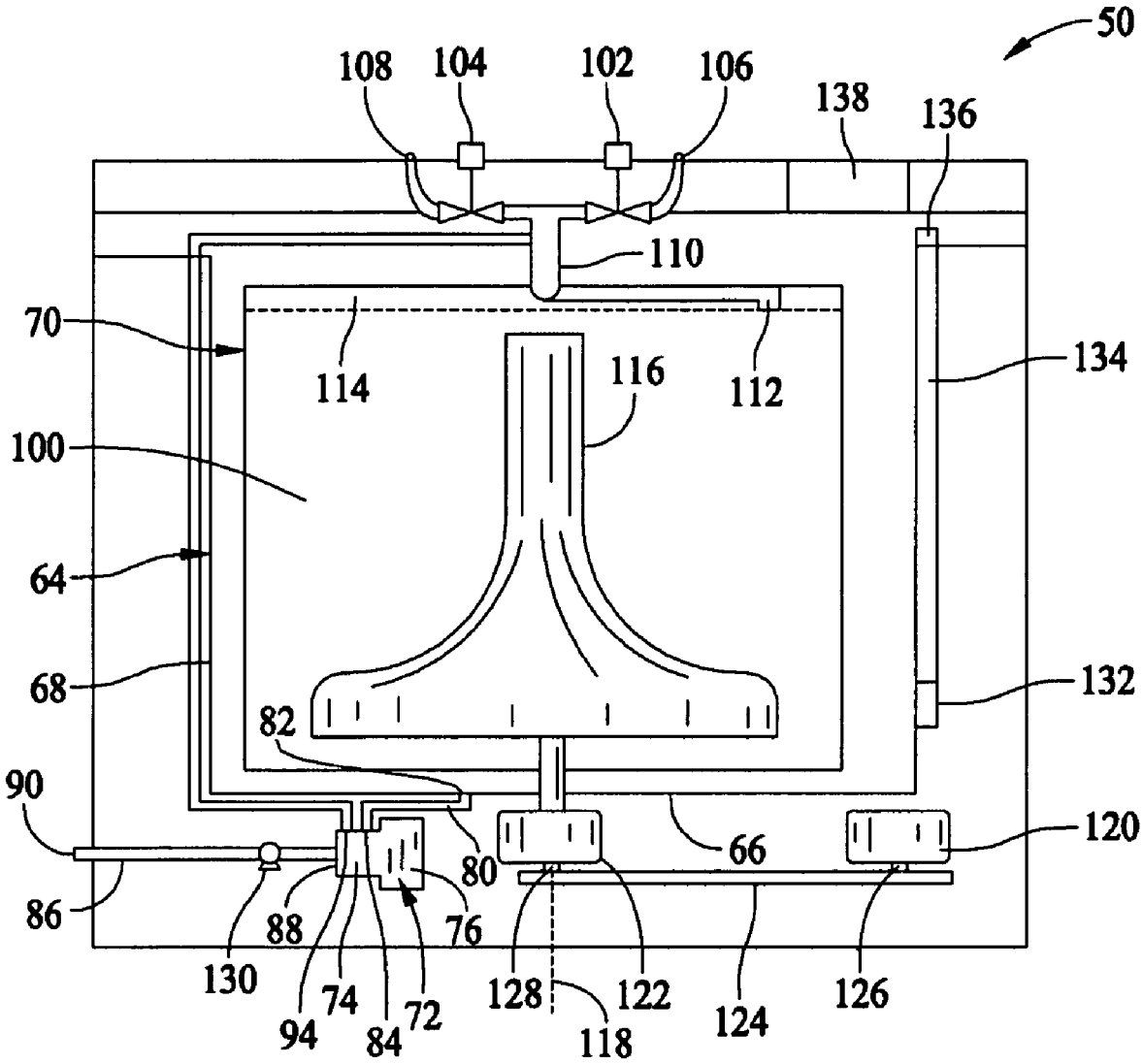
FIG. 2 is front elevational schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 64 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Second pump outlet hose 92, liquid valves 102, 104, and liquid hoses 106, 108 are connected to basket inlet tube 110, and fluid, water and/or recirculated wash liquid, is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted with either water, wash solution, or recirculated wash liquid even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 may be a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, transmission and clutch system 122 and belt 124 collectively are referred herein as a machine drive system.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated to drain wash liquid from basket 70 and tub 64 through drain outlet 90 and a drain valve 130 during appropriate points in washing cycles as machine 50 is used. In an exemplary embodiment, pump assembly 72 is selectively activated to drain wash liquid from tub 64 and recirculate the wash liquid to basket 70 via second pump outlet hose 92 during appropriate points in washing cycles.

In an exemplary embodiment, machine 50 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, and voltage or current phase shifts.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, clothes are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of clothes in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Clothes are then rinsed and portions of the cycle repeated, including the agitation phase, depending on the particulars of the wash cycle selected by a user.

Figure 3:
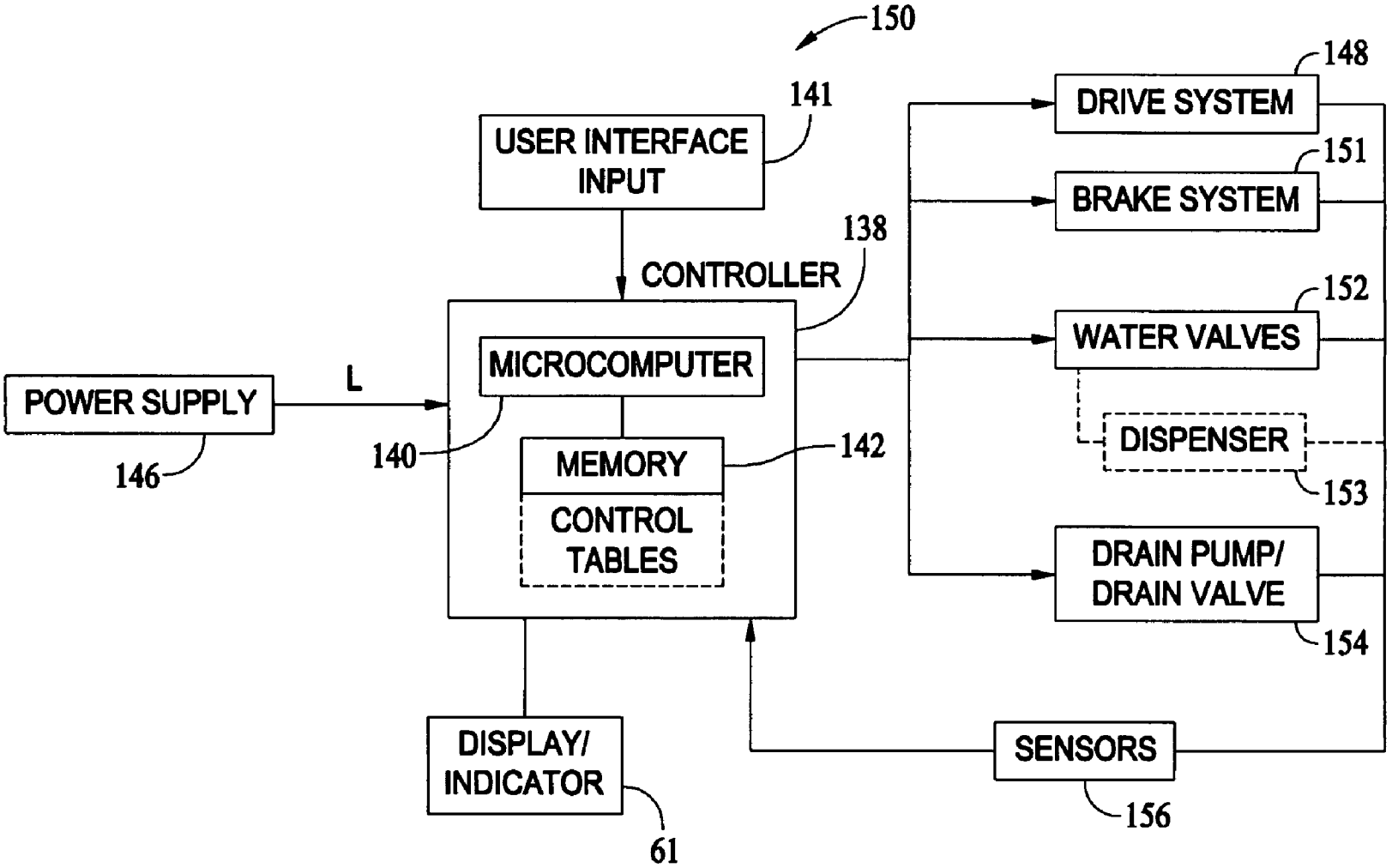
FIG. 3 is a schematic block diagram of a control system for the washing machine shown in FIGS. 1 and 2.

FIG. 3 is a schematic block diagram of an exemplary washing machine control system 150 for use with washing machine 50 (shown in FIGS. 1 and 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120, clutch system 122, and agitation element 116 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70.

In response to manipulation of user interface input 141 controller 138 monitors various operational factors of washing machine 50 with one or more sensors or transducers 156, and controller 138 executes operator selected functions and features according to known methods. Of course, controller 138 may be used to control washing machine system elements and to execute functions beyond those specifically described herein. Controller 138 operates the various components of washing machine 50 in a designated wash cycle familiar to those in the art of washing machines.

Washing machines typically have a wash cycle consisting of a fill period, agitation period and a drain period. During the agitation period, the laundry load is mechanically energized in water-detergent liquid, sometimes called wash liquid to remove soil and stains. Lower levels of water usage can be obtained by modifying the typical cycle to include an intermittent to continuous recirculation of the wash liquid from the tub back into the basket, momentary application of high stroke rates to turn over the laundry load, and an initial application of wash liquid at low temperatures and high detergent concentration.

Figure 4:
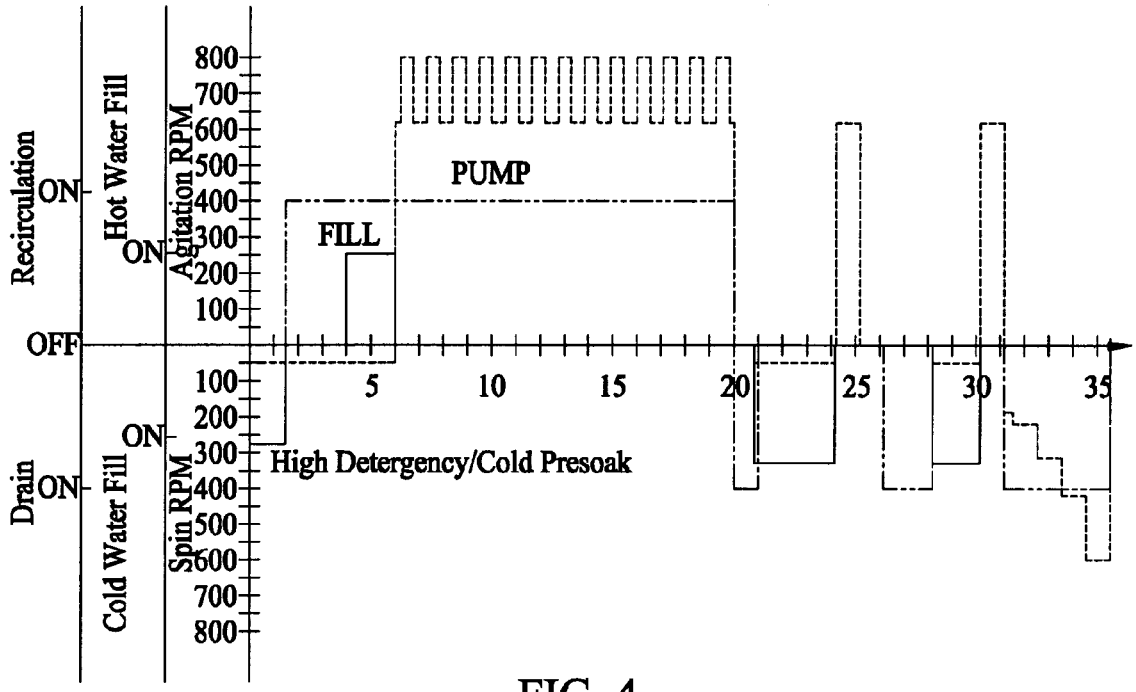
FIG. 4 is an exemplary illustration of a graph of a wash cycle.

FIG. 4 graphically depicts an exemplary wash cycle that may be executed by washing machine 50. In the illustrated cycle, detergent is applied on top of the laundry load or between tub 64 and basket 70 prior to wash cycle startup. An initial fill of 3.5 gallons or less of water is sprayed or applied over the laundry load as basket 70 is driven at a slow spin of about twenty to sixty rpm. Slow spin of basket 70 ensures that the laundry load is sufficiently wetted prior to the wash cycle and mixes any detergent applied to the laundry load into the wash liquid. The spin speed is sufficiently slow that articles in the laundry load are not driven outwardly by momentum. After the initial fill, controller 138 initiates recirculation of the concentrated wash liquid from tub 64 to basket 70 using pump assembly 72 and outlet hose 92. Alternatively, recirculation of the concentrated wash liquid may be initiated during the initial fill. Operation of pump assembly 72 may be continuous or may be limited to those periods where pump assembly 72 is not cavitating. Cavitation may be detected either through water level in tub 64 or current draw from pump assembly 72 as detected by controller 138.

After the initial fill, controller 138 initiates a pretreat cycle wherein the concentrated wash liquid is recirculated over a time period of from about thirty seconds to about twenty minutes, with a typical duration being about four minutes. Basket 70 is driven at a slow spin throughout the recirculation of the concentrated wash liquid.

After the pretreat cycle, hot and cold water is applied or sprayed into basket 70 until the final water level pre-selected by the user or determined by the washer control algorithms is reached. Basket 70 is driven at a slow spin throughout the fill operation. Recirculation is also continued throughout the fill operation.

When the final wash cycle fill is completed, the spin of basket 70 is stopped, however, recirculation of the wash liquid continues. The recirculation rate of wash liquid from tub 64 into basket 70 is maintained at a rate such that the bulk or majority of the wash liquid in tub 64 and basket 70 resides in basket 70. That is, the recirculation rate is adjusted so that wash liquid is removed from an annular space between tub 64 and basket 70 and returned to basket 70 maintaining wash liquid in basket 70 at a first level while maintaining wash liquid in the annular space at a second level that is lower than the first level. More wash liquid is made available for use in basket 70 where it provides more buoyancy to the laundry load. Increased buoyancy of the laundry load facilitates agitation of the laundry load during the agitation portions of the wash cycle. More specifically, the availability of the wash liquid in the annular space for use in the basket facilitates washing larger loads with a given volume of wash liquid. In an exemplary embodiment, four to five gallons of wash liquid may be retrieved from the annular space. This is accomplished by balancing the overall flow restriction (hole size and count) through basket 70, the desired water level in basket 70, and the capacity of pump assembly 72.

Figure 5:
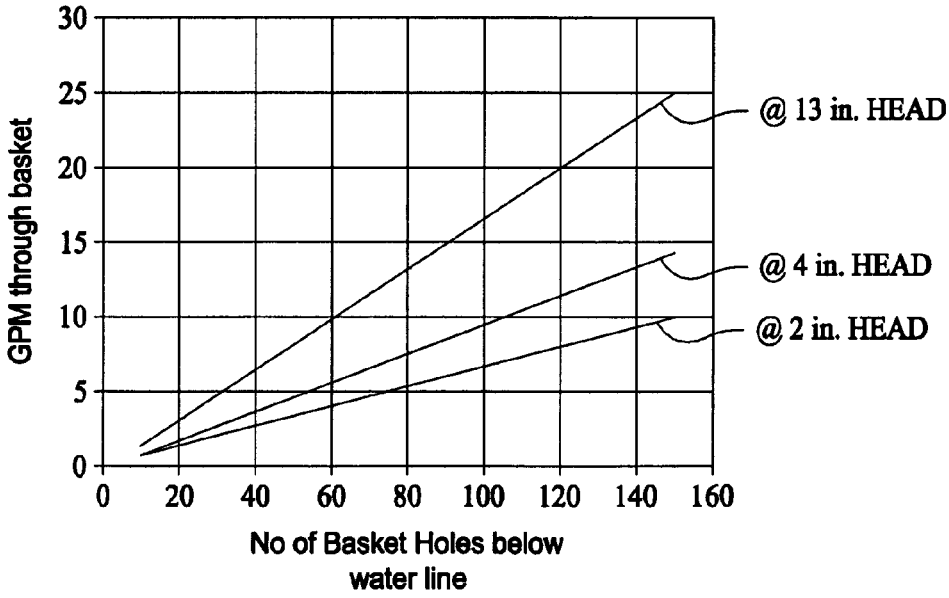
FIG. 5 is an exemplary illustration of a graph of the relationship between flow rate and number of basket holes in the basket.

FIG. 5 illustrates a relationship between flow rate and the number of holes in a basket such as basket 70 for three different basket-to-tub wash liquid level differentials (heads) of thirteen inches, four inches, and two inches. As shown in FIG. 5, flow rate through basket 70 increases as the desired wash liquid level differential between tub 64 and basket 70 increases. As would also be expected, the flow rate of wash liquid through basket 70 increases as the number of holes below a given water line increases.

Recirculation of the wash liquid continues during the agitation cycle. When the agitation cycle is completed, recirculation is stopped and drainage of the wash liquid is started. In one embodiment, a slow spin of basket 70 may be initiated to assist in a timely drainage of wash liquid from basket 70 prior to the rinse cycles.

The above described methods and systems facilitate reducing water usage in a washing machine while maintaining washability. More specifically, the described systems and methods facilitate wetting of the laundry load and agitation of the laundry load during the wash cycle, particularly in the case of large laundry loads. Overall energy use and wear of laundry items is also reduced.

While the invention has been described in terms of various specific embodiments, those skilled in the art will recognize that the invention can be practiced with modification within the spirit and scope of the claims.

What is claimed is:

1. A washing machine comprising:

a tub;

a liquid level sensing device, said liquid level sensing device coupled to said tub and positioned to sense a level of liquid in said tub;

a perforated basket rotationally mounted within said tub for relative rotation therewith;

a basket inlet tube coupled to a pump outlet hose, and at least one of a cold liquid hose and a hot liquid hose, said basket inlet tube positioned between said tub and said basket;

a recirculation system coupled to said basket inlet tube, said recirculation system configured to continuously remove wash liquid directly from said tub and continuously return wash liquid to said basket through said pump outlet hose; and a controller operatively coupled to said washing machine, said controller configured to recirculate a wash liquid within said washing machine using the recirculation system, said controller comprising a microcomputer coupled to a memory storing instructions that, when executed by the microcomputer, directs said controller to:

fill said basket with no more than about 3.5 gallons of the wash liquid during a first fill period;

begin recirculation of the wash liquid using said recirculation system; and continue the recirculation of the wash liquid for at least a time period prior to a second fill period.

2. A washing machine in accordance with claim 1 wherein said controller is configured to begin recirculation of the wash liquid during the first fill period.

3. A washing machine in accordance with claim 1 wherein said controller is configured to fill said basket with about 3.5 gallons of the wash liquid during the first fill period.

4. A washing machine in accordance with claim 1 wherein said controller is configured to continue the recirculation of the wash liquid for at least a time period while slowly spinning said basket, a length of said time period is at least a length of a pretreat cycle.

5. A washing machine in accordance with claim 1 wherein said controller is configured to continue the recirculation during the second fill period while slowly spinning said basket.

6. A washing machine in accordance with claim 1 wherein said recirculation system comprises a pump including an inlet and an outlet, said inlet and outlet configured to be coupled to said tub and said basket so that the wash liquid received in said pump inlet from said tub is returned to said basket from said pump outlet, said controller being operatively coupled to said pump to control said pump based on a preselected wash cycle.

7. A washing machine comprising:

a tub;

a liquid level sensing device, said liquid level sensing device coupled to said tub and positioned to sense a level of liquid in said tub;

a perforated basket rotationally mounted within said tub for relative rotation therewith;

an annular space positioned between said tub and said basket;

a basket inlet tube coupled to a pump outlet hose, and at least one of a cold liquid hose and a hot liquid hose, said basket inlet tube positioned between said tub and said basket;

a recirculation system coupled to said basket inlet tube, said recirculation system configured to continuously remove wash liquid directly from said tub and continuously return wash liquid to said basket through said pump outlet hose; and a controller operatively coupled to said washing machine, said controller configured to recirculate a wash liquid within said washing machine using the recirculation system, said controller comprising a microcomputer coupled to a memory storing instructions that, when executed by the microcomputer, directs said controller to:

fill said basket with the wash liquid during a fill period;

recirculate the wash liquid after the fill period at a recirculation rate such that the wash liquid is removed from said annular space and returned to said basket; and maintain the wash liquid in said basket at a first level while maintaining the wash liquid in said annular space at a second level that is lower than the first level.

8. A washing machine in accordance with claim 7 wherein said recirculation system comprises a pump including an inlet and an outlet, said inlet and outlet configured to be coupled to said tub and said basket so that the wash liquid received in said pump inlet from said tub is returned to said basket from said pump outlet, said controller being operatively coupled to said pump to control said pump based on a preselected wash cycle.

9. A washing machine in accordance with claim 8 wherein said controller is configured to establish said recirculation rate based on a pump capacity.

10. A washing machine in accordance with claim 8 wherein said controller is configured to establish said recirculation rate based on a size and number of perforations in said basket.

11. A washing machine in accordance with claim 7 wherein said recirculation rate is controlled to maintain the wash liquid in said basket at the first level.

* * * * *